US006919520B2

(12) United States Patent
Kasakawa et al.

(10) Patent No.: US 6,919,520 B2
(45) Date of Patent: Jul. 19, 2005

(54) STOPLIGHT SWITCH AND MOUNTING METHOD

(75) Inventors: Noriyuki Kasakawa, Fukui (JP); Masahiro Hirobe, Shiga (JP); Toshio Osawa, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 147 days.

(21) Appl. No.: 10/644,005

(22) Filed: Aug. 20, 2003

(65) Prior Publication Data

US 2005/0023117 A1 Feb. 3, 2005

(30) Foreign Application Priority Data

Aug. 23, 2002 (JP) ..... 2002-243067
Dec. 20, 2002 (JP) ..... 2002-370315

(51) Int. Cl.[7] ..... H01H 3/14; H01H 13/02
(52) U.S. Cl. ..... 200/61.89; 200/520; 200/531
(58) Field of Search ..... 200/61.87, 61.88, 200/61.89, 86.5, 243, 520–536, 537–573, 237–292

(56) References Cited

U.S. PATENT DOCUMENTS 2,881,278 A * 4/1959 Gores ..... 200/61.89
3,115,559 A * 12/1963 Cass et al. ..... 200/61.89
3,638,181 A * 1/1972 Bryant ..... 200/61.53
4,181,834 A * 1/1980 Kyonomine ..... 200/61.89
4,227,060 A * 10/1980 Ayres et al. ..... 200/61.89
4,297,550 A * 10/1981 Leighton ..... 200/61.89
4,604,506 A * 8/1986 Gebhardt ..... 200/61.89
5,512,717 A * 4/1996 Magome et al. ..... 200/295
5,826,709 A * 10/1998 Jacob ..... 200/530
5,889,246 A * 3/1999 Frank et al. ..... 200/61.89
5,929,407 A * 7/1999 Ziem ..... 200/61.89
6,653,582 B2 * 11/2003 Kasakawa et al. ..... 200/86.5

FOREIGN PATENT DOCUMENTS

JP 10-149736 6/1998

* cited by examiner

*Primary Examiner*—James R. Scott
(74) *Attorney, Agent, or Firm*—Wenderoth, Lind & Ponack, L.L.P.

(57) ABSTRACT

With the stoplight switch and method for its mounting in accordance with the present invention, by configuring the stoplight switch in a manner such that a contact section of a spacer projecting out from a through-hole on the side surface of a case is made to come into contact with an end portion of a U-shaped engagement spring that is supported by a sliding body thereby to press the pressing section so as to move the spacer and secure the action rod and the sliding body, mounting work and adjustment of the action rod are made easy.

5 Claims, 10 Drawing Sheets

STOPLIGHT SWITCH AND MOUNTING METHOD

FIELD OF THE INVENTION

The present invention relates to a stoplight switch to be used in switching on and off a stoplight of a vehicle when operating a brake pedal and a method of mounting the stoplight switch.

BACKGROUND OF THE INVENTION

In recent years, many types of stoplight switches for stoplight control are used in which, in order to assure lighting of a stoplight at the time a brake pedal of a vehicle is depressed and going off of the light when released, the length of the action rod of the switch can be adjusted after being mounted on a bracket disposed opposite the brake pedal.

Referring to FIG. 9 and FIG. 10, a description will be given on such a conventional stoplight switch.

FIG. 9 is a cross-sectional view of a conventional stoplight switch. In FIG. 9, case 1 that is cylindrical in shape is made of electrically insulating resin and has an open top surface. Sliding body 2 is housed in case 1 in a manner vertically movable. A plurality of fixed contacts 3 are planted in case 1 in a manner such that terminals 3A project out from bottom surface 1A.

A switch contact is configured in a manner such that movable contact 4 made of a conductive metal is in resilient contact with fixed contacts 3 by means of pressing spring 5 that is mounted between movable contact 4 and bottom surface 1A of case 1 in a slightly pressed state.

Also, return spring 6 is mounted in a slightly pressed state between a lower surface of sliding body 2 and bottom surface 1A of case 1 so as to urge sliding body 2 upward.

Furthermore, the bottom end of action rod 7 is inserted into hole 2A in the center of sliding body 2. Cover 8 covers the upper opening of case 1. A plurality of projections and depressions sections 7A are provided on the periphery of action rod 7, and the top end of action rod 7 projects upward from a through-hole in the center of cover 8.

Stoplight switch 10 is configured in a manner such that end portions of engagement spring 9 which is roughly U-shaped are supported by sliding body 2 while the slightly widened middle portion is in resilient contact with projections and depressions sections 7A of action rod 7.

Next, referring to an external view of FIG. 10, a description will be given on a method of mounting stoplight switch of this configuration on a vehicle.

In FIG. 10, brake pedal 11 is urged rightward by spring member 13 and the like.

Stoplight switch 10 is mounted by inserting into a mounting hole (not drawn) of mounting bracket 12 and secured by turning in an engaging section provided on cover 8. At this time, as action rod 7 is urged by return spring 6 as well as is positioned by engagement spring 9 in a manner projecting out from a predetermined position, it presses brake pedal 11 leftward.

Therefore, as it is not possible to adjust the length of action rod 7 as it is, brake pedal 11 is held with a hand so that it will not move leftward, and stoplight switch 10 is mounted on mounting bracket 12 in that state. This way, the front end of action rod 7 touches contact surface 11A of brake pedal 11 and is depressed.

For this reason, as sliding body 2 that supports action rod 7 with engagement spring 9 moves downward from the state illustrated in FIG. 9 while depressing return spring 6 and presses movable contact 4, movable contact 4 moves downward while depressing pressing spring 5 and detaches itself from fixed contacts 3 thus leaving the switch contacts in an "off" state.

Next, when the bottom end of sliding body 2 comes into contact with bottom surface 1A of case 1 through movable contact 4 thus making sliding body 2 unable to move downward any more, action rod 7 moves downward through hole 2A of sliding body 2 while expanding engagement spring 9 that is in resilient contact with projections and depressions sections 7A. When mounting is finished, engagement spring 9 comes into resilient contact with projections and depressions sections 7A at that position, and action rod 7 is held at a predetermined position of sliding body 2.

In summary, by mounting stoplight switch 10 on mounting bracket 12 in a state in which brake pedal 11 is being held, the switch contacts come to an "off" position and, at the same time, action rod 7 is depressed to a predetermined position thus enabling simultaneous adjustment of the length of action rod 7.

Subsequently, a connector or the like is fit to terminals 3A of fixed contacts 3 that project out from bottom surface 1A of case 1 for connection to a stoplight (not shown).

When brake pedal 11 is depressed in a state in which action rod 7 has been depressed thus making switch contact and stoplight "off", as contact surface 11A is separated from action rod 7, sliding body 2 moves upward by the pressure of return spring 6. At the same time, movable contact 4 pressed by pressing spring 5 comes into resilient contact with fixed contacts 3 making switch contact "on" thus lighting the stoplight.

As a prior art literature relating to the invention of the present patent application, Japanese Patent Laid-Open Application No. H10-149736 is known.

However, when mounting stoplight switch 10 on a vehicle, the above-described conventional stoplight switch suffered a problem of requiring complicated and time-consuming work because the stoplight switch is mounted while adjusting the length of action rod 7 in a state in which brake pedal 11 is being held.

SUMMARY OF THE INVENTION

A stoplight is provided that comprises a cylindrical case made of insulating resin and having an open upper surface, a vertically movable sliding body housed in the case, switch contacts for making or breaking an electric circuit by vertical motion of the sliding body, a cover for covering the opening of the case and having a through-hole through which the bottom end of an action rod is inserted into the sliding body and a through-hole through which the action rod projects upward, a roughly U-shaped engagement spring supported by the sliding body, and a spacer of which a pressing section extends out toward the bottom surface or side surface of the case and a contact portion comes in contact with the end portion of the U-shaped engagement spring so as to hold the engagement spring in an expanded state, and structured in a manner such that the end portion of the engagement spring comes off from the contact portion by the upward movement of the spacer and closes thus fixing the action rod relative to the sliding body.

DESCRIPTION OF THE PREFERRED EMBODIMENT

A description of an exemplary embodiment of the present invention will be given in the following in reference to FIG. 1 to FIG. 8.

In the description, structural components similar to those in the prior art description are denoted with the same reference numbers and detailed descriptions of them are omitted.

(Exemplary Embodiment)

Figure 1A:
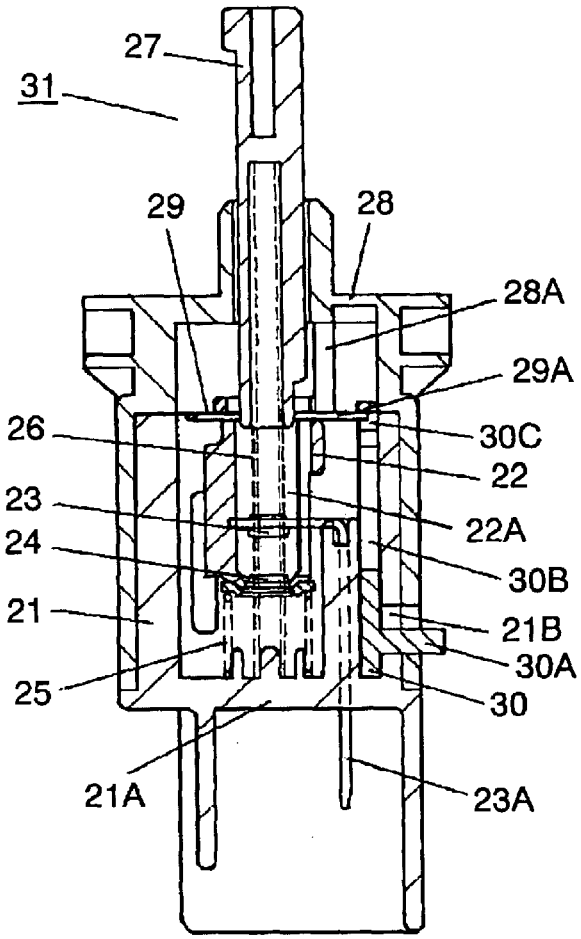
FIG. 1 is a cross-sectional view of a stoplight switch in an exemplary embodiment of the present invention.
Figure 1B:
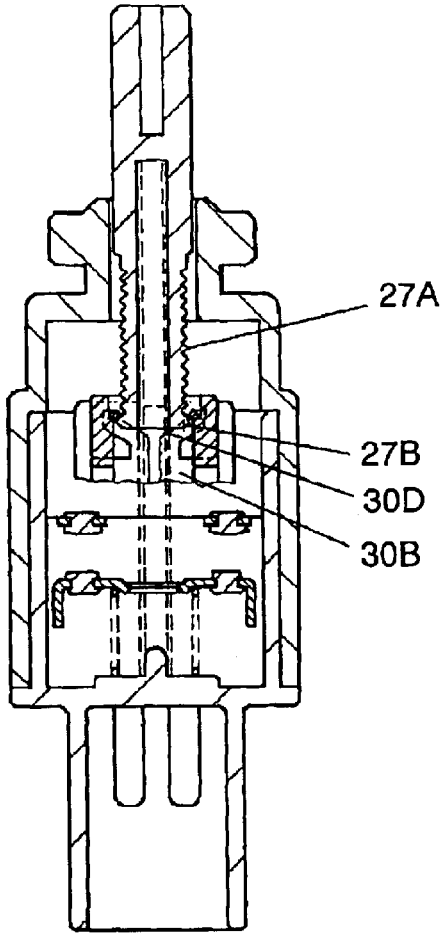
Figure 2:
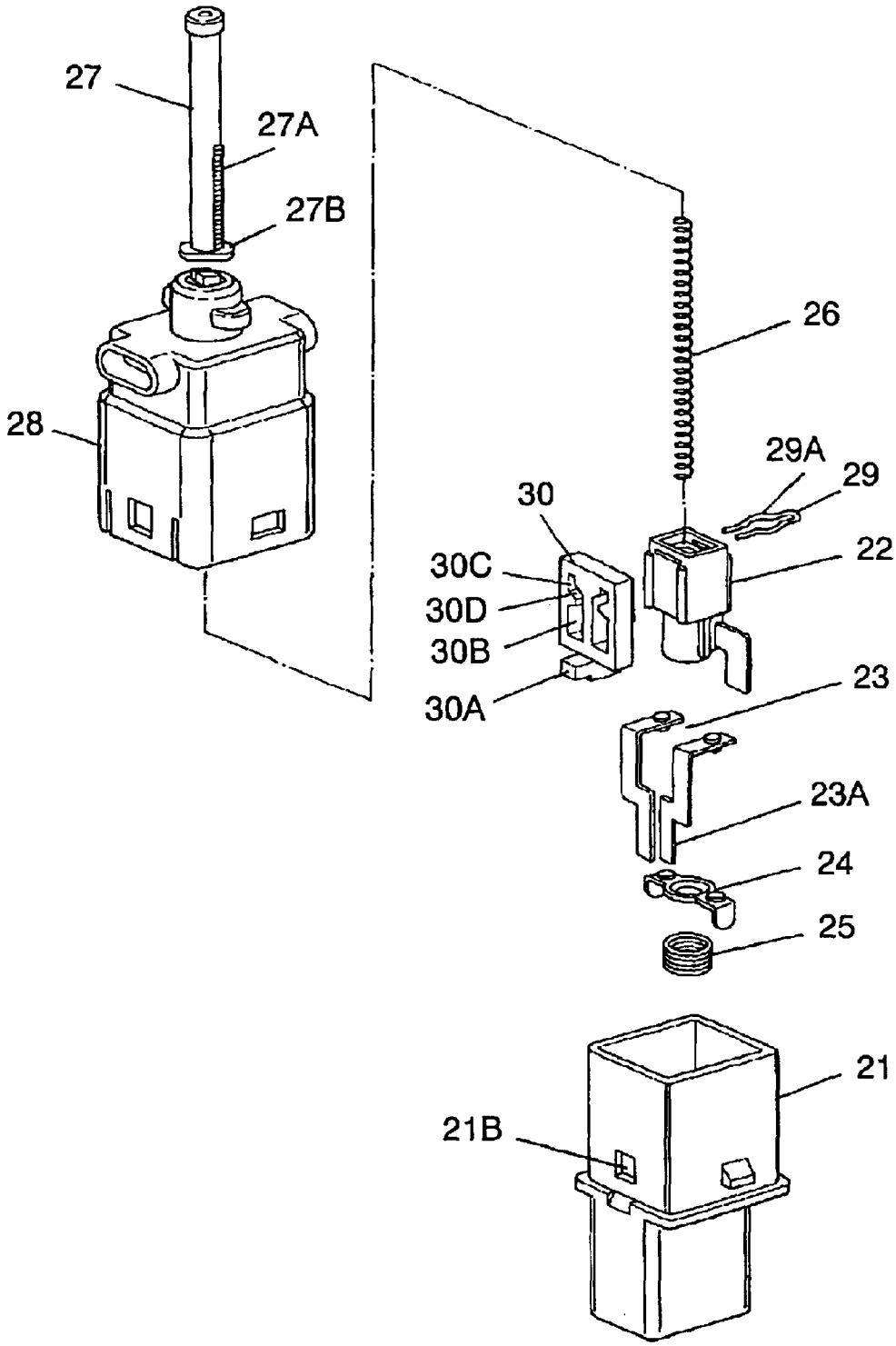
FIG. 2 is an exploded perspective view of the stoplight switch.
Figure 3:
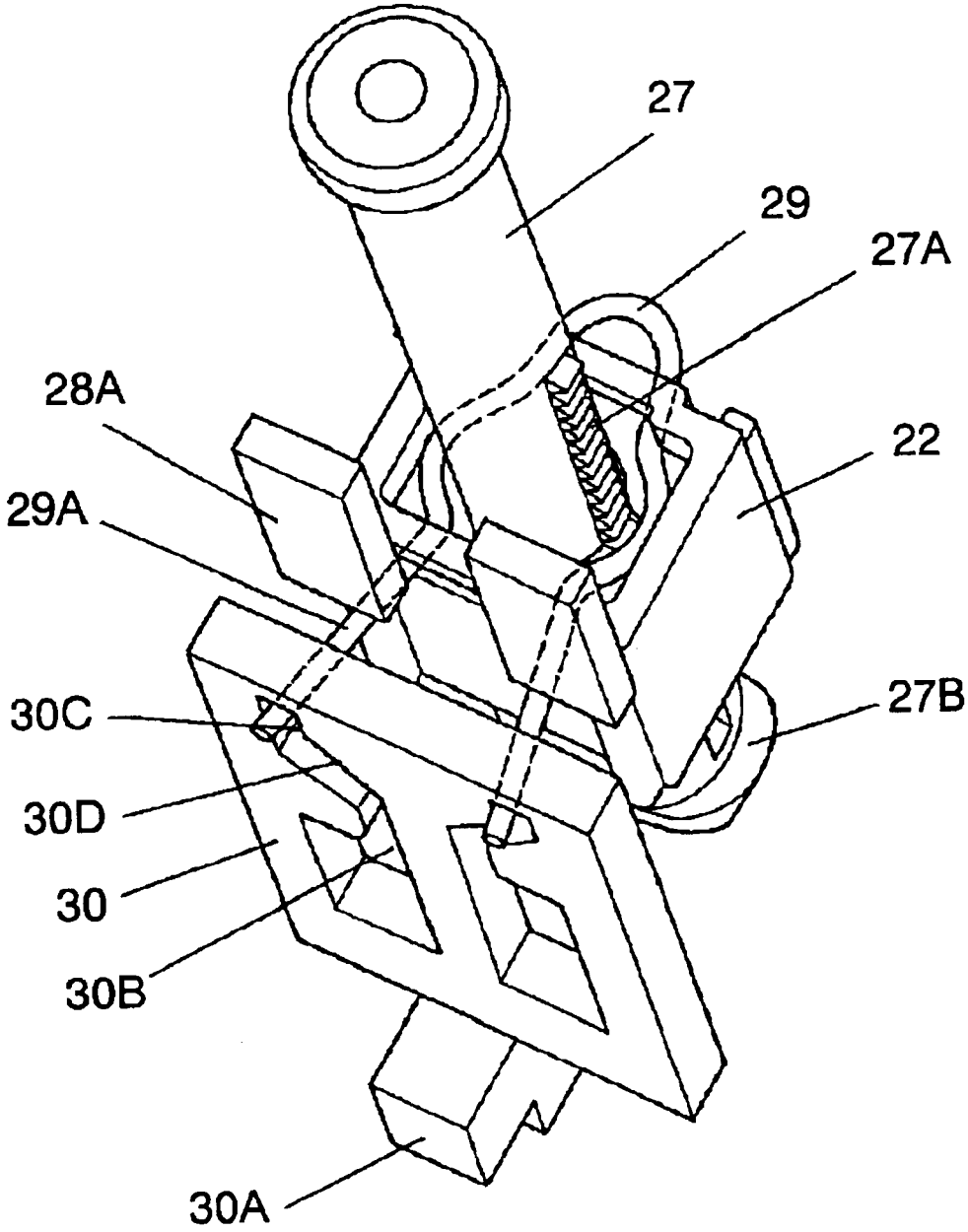
FIG. 3 is a perspective view of an essential part of the stoplight switch.

FIG. 1 is a cross-sectional view of a stoplight switch in an exemplary embodiment of the present invention. FIG. 2 is an exploded perspective view of the stoplight switch. FIG. 3 is a perspective view of an essential part of the stoplight switch with the action rod slightly depressed. In FIG. 1 to FIG. 3, cylindrical case 21 made of insulating resin has an open top surface. Sliding body 22 is housed in case 21 in a vertically movable manner. A plurality of fixed contacts 23 are planted in case 21 in a manner such that terminal portions 23A project out through bottom surface 21A.

Pressing spring 25 is mounted in a slightly depressed state between bottom surface 21A of movable contact 24 made of conductive metal and bottom surface 21A of case 21. Switch contacts are configured in a manner such that movable contact 24 is disposed opposite fixed contacts 23 with a predetermined distance in between.

Also, bottom end of action rod 27 is inserted into hole 22A in the center of sliding body 22. Return spring 26 is mounted between the bottom surface of action rod 27 and bottom surface 21A of case 21 in a slightly depressed manner so as to urge action rod 27 upward.

Furthermore, cover 28 covers the opening of case 21. The top end of action rod 27 projects out upward through a hole in the center of cover 28. Saw-tooth-shaped projections and depressions section 27A is provided on the outer surface of action rod 27.

Also, pressing section 30A of spacer 30 projects out from through-hole 21B on the side of case 21. End portions of roughly U-shaped engagement spring 29 are supported by sliding body 22 and action rod 27 passes through a slightly expanded middle portion of engagement spring 29. The tips of both ends of arm portion 29A are in resilient contact with contact portion 30C located above square hole 30B of spacer 30 on the bottom surface of which slant section 30D is provided.

Protruding section 27B is provided on the bottom end of action rod 27. In the assembly of a switch, when inserting action rod 27 into hole 22A of sliding body 22, this protruding section 27B engages the middle portion of engagement spring 29 thus temporarily holding action rod 27 in sliding body 22.

Stoplight switch 31 is structured in a manner such that the bottom ends of two engagement sections 28A that project out from the bottom of cover 28 come in contact with arm portions 29A of engagement spring 29 thus pushing down sliding body 22 that supports engagement spring 29, bottom end of sliding body 22 presses movable contact 24 while depressing pressing spring 25 thus maintaining a predetermined gap with respect to fixed contacts 23 and keeping the switch contacts at an "off" state.

Figure 4:
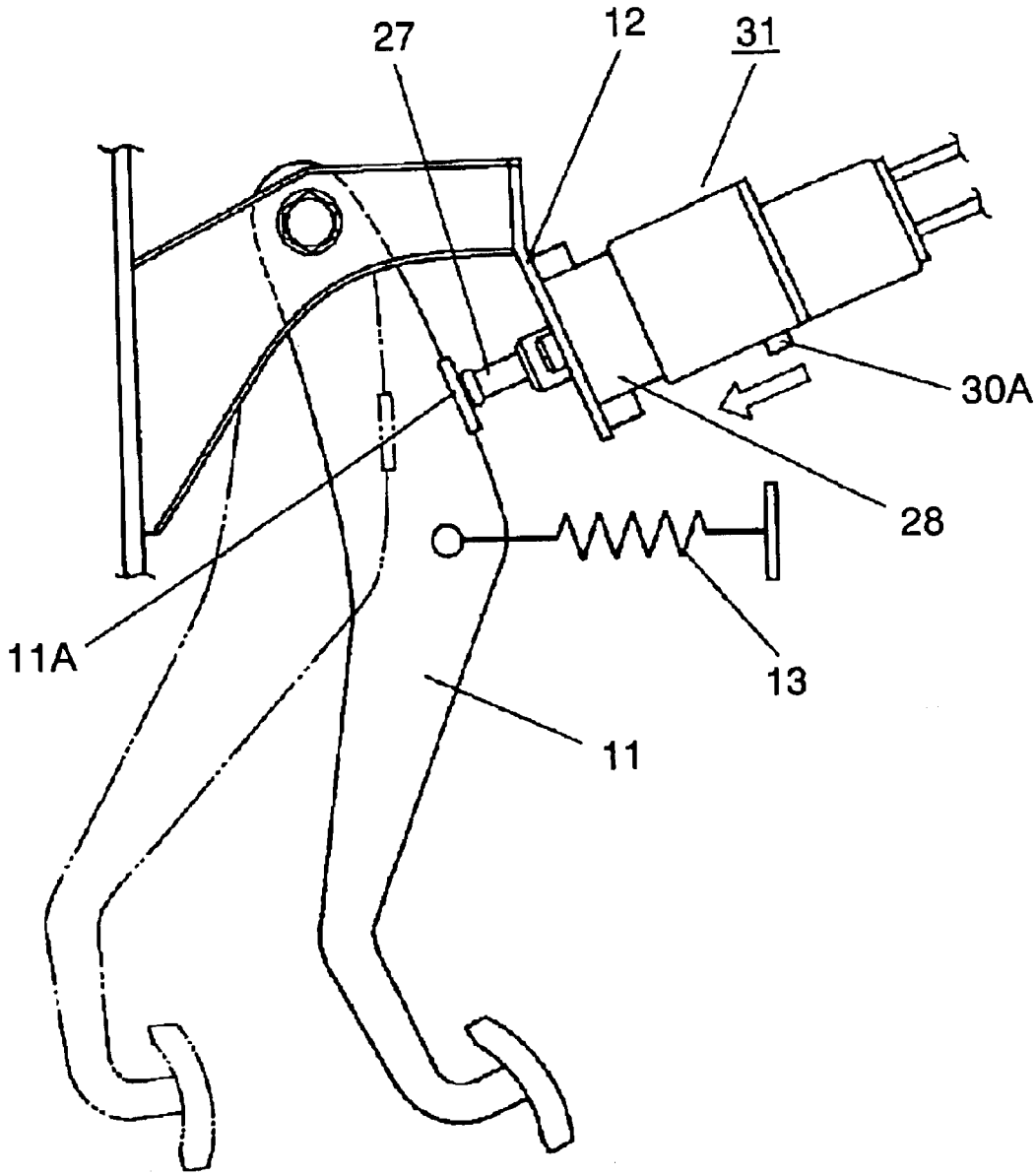
FIG. 4 is an external view of the stoplight switch while being mounted on a vehicle.

Referring to the external view as shown in FIG. 4, a description will now be given on the method of mounting a stoplight switch having this structure on a vehicle.

In FIG. 4, brake pedal 11 is urged rightward by spring member 13 or the like.

Stoplight switch 31 is inserted into a mounting hole (not shown) of mounting bracket 12 and turned so as to be secured to an engaging section formed on cover 28. During this process, the tip of action rod 27 that projects out from a predetermined position comes into contact with contact surface 11A of brake pedal 11.

Figure 5:
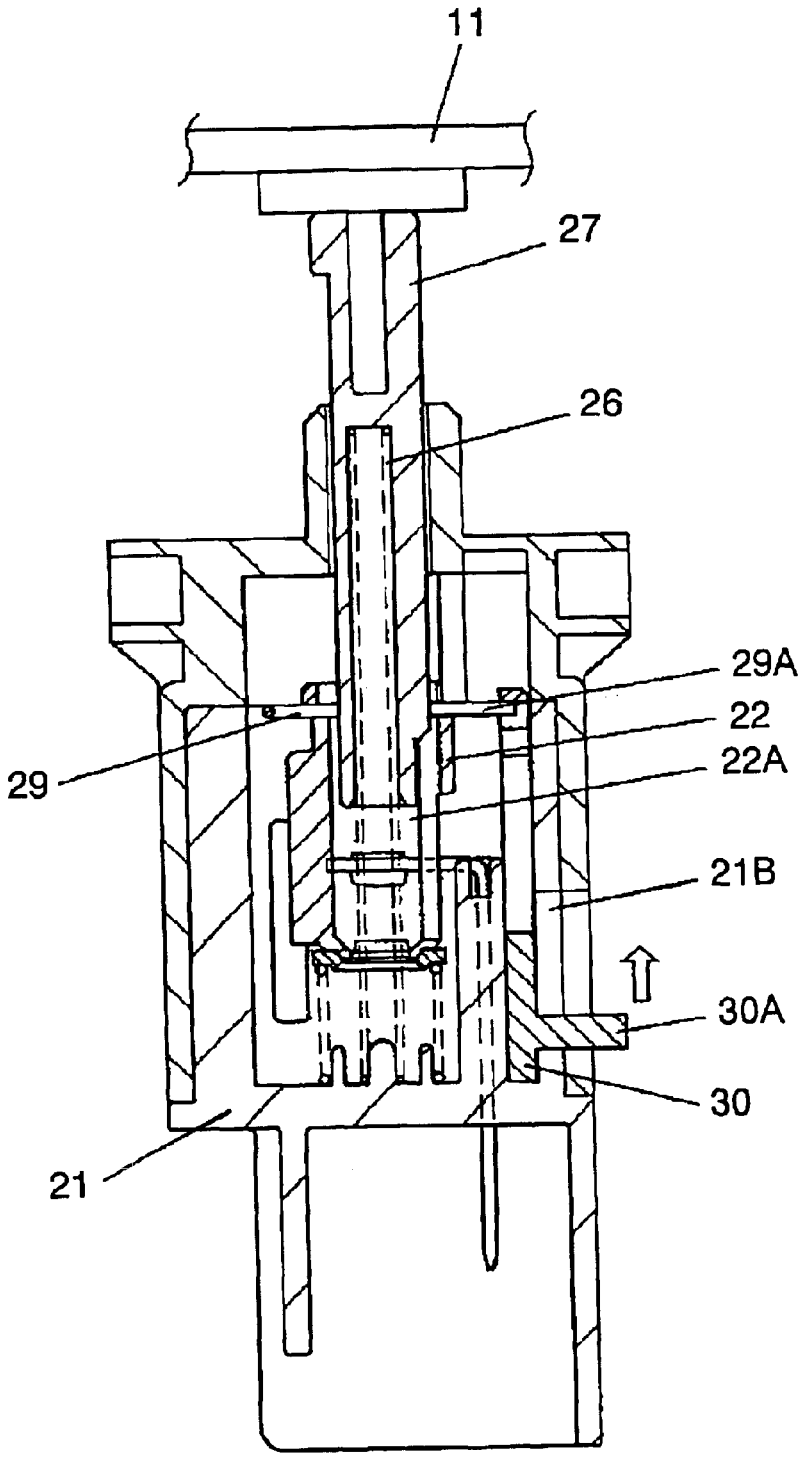
FIG. 5 is a cross-sectional view of the stoplight switch while the action rod is being adjusted.

Consequently, as shown in the cross-sectional view of FIG. 5, action rod 27 is moved downward inside hole 22A of sliding body 22 to a predetermined position while depressing return spring 26.

Figure 6:
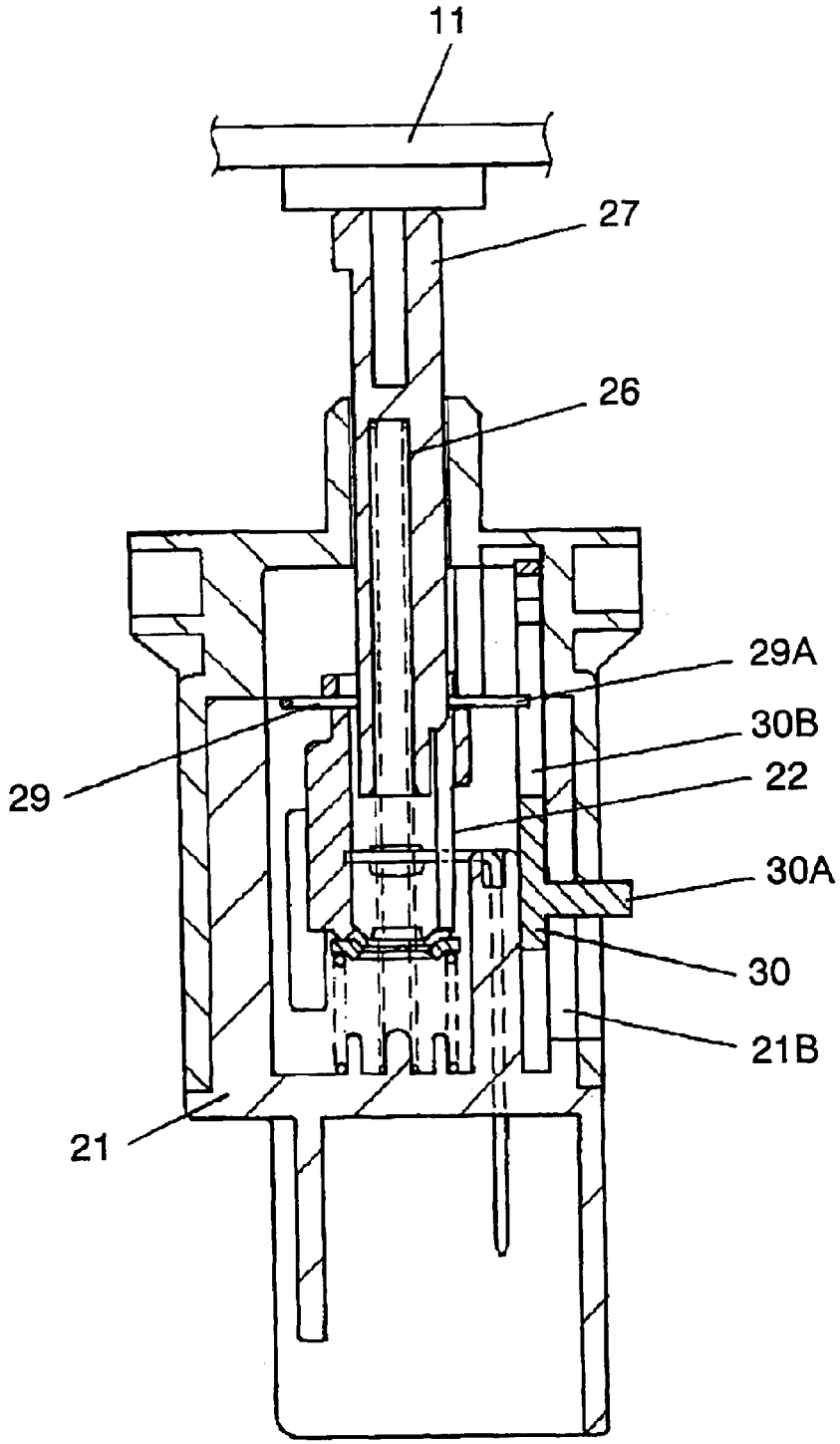
FIG. 6 is a cross-sectional view of the stoplight switch while a connector is being attached.

When pressing section 30A on the side surface of spacer 30 that projects out from through-hole 21B on the side surface of case 21 is pressed upward, that is, in the direction toward brake pedal 11, in a state in which action rod 27 has been depressed to a predetermined position and the length has been adjusted, spacer 30 is moved upward as shown in the cross-sectional view of FIG. 6.

Figure 7:
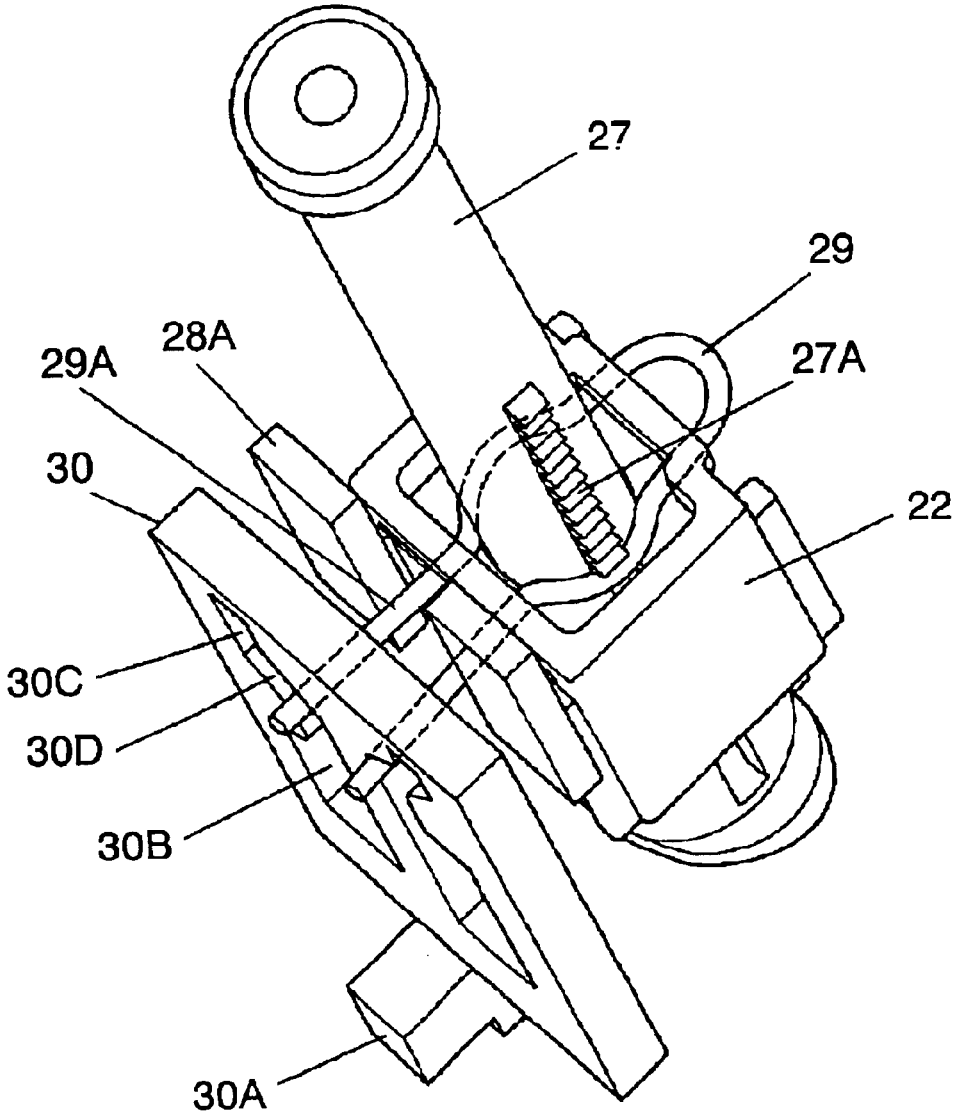
FIG. 7 is a perspective view of an essential part of the stoplight switch.

As a result, as the tips of arm portions 29A on both ends of engagement spring 29 come off from contact portion 30C of spacer 30 and move into square hole 30B as shown in the perspective view of an essential part of FIG. 7, engagement spring 29 that has been expanded contracts and the middle portion comes into resilient contact with saw-tooth-shaped projections and depressions sections 27A of action rod 27 thus securing action rod 27 to sliding body 22.

Also, at the same time, as engagement spring 29 contracts and disengages arm portions 29A from engaging section 28A of cover 28, sliding body 22 that supports engagement spring 29 and action rod 27 secured to it are made to be upwardly movable.

During this process, in the event action rod 27 is secured to sliding body 22 with a wrong length by inadvertently touching action rod 27, for instance, by pushing pressing section 30A on the side surface of spacer 30 downward, readjustment of the length of action rod 27 can be performed as spacer 30 moves downward and the state illustrated in FIG. 3 is restored.

Furthermore, as the bottom surface of contact portion 30C of spacer 30 has slant section 30D, when moving spacer 30 downward, engagement spring 29 smoothly expands due to slant section 30D thus enabling easy movement of spacer 30.

After securing action 27 to sliding body 22 and readjusting in this way, a connector or the like is fit to terminal portions 23A of fixed contacts 23 that project out from bottom surface 21A of case 21 thus completing connection to a stoplight (not shown).

Figure 8:
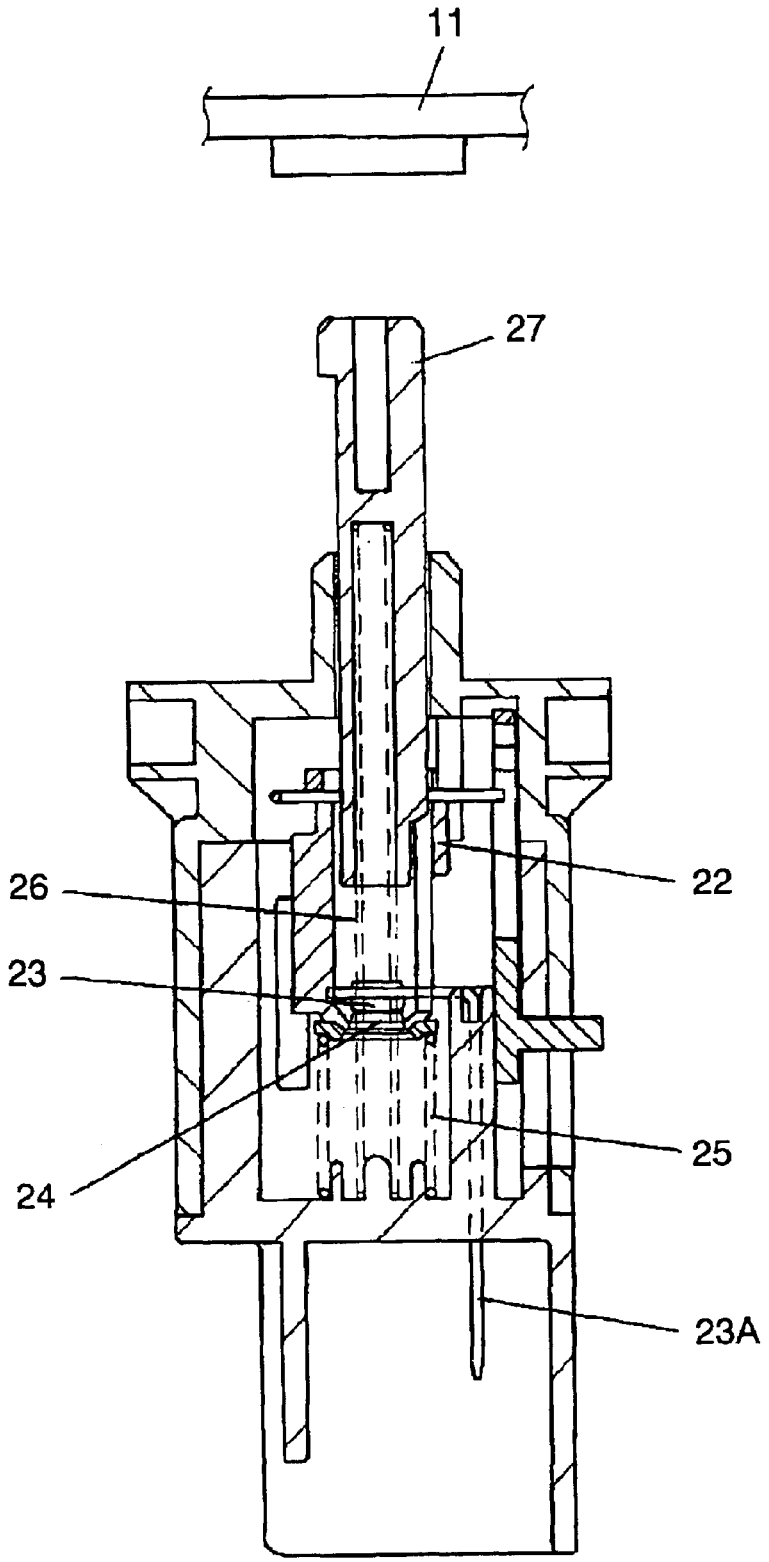
FIG. 8 is a cross-sectional view of the stoplight switch when depressing force is released.
Figure 9:
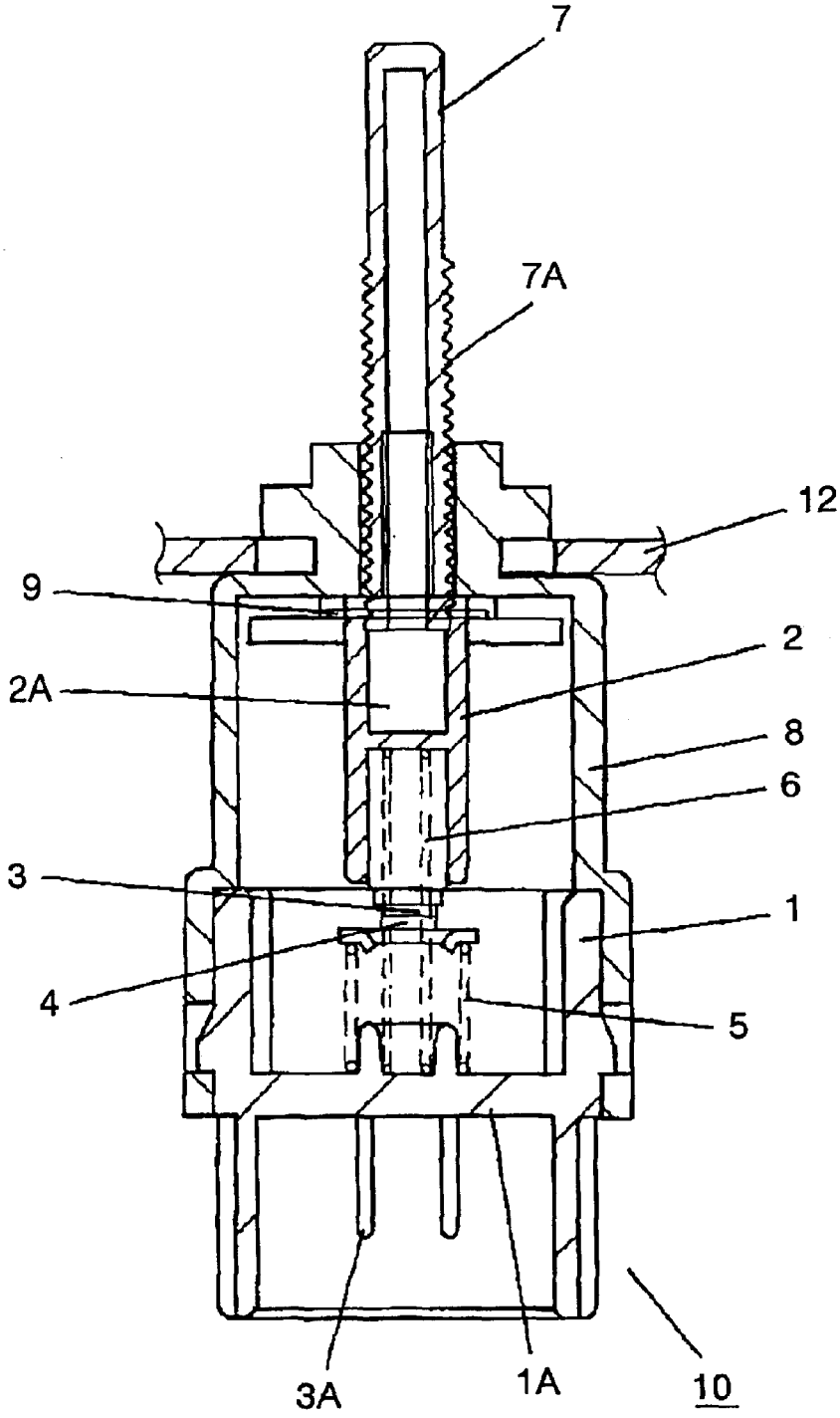
FIG. 9 PRIOR ART
FIG. 9 is a cross-sectional view of a conventional stoplight switch.
Figure 10:
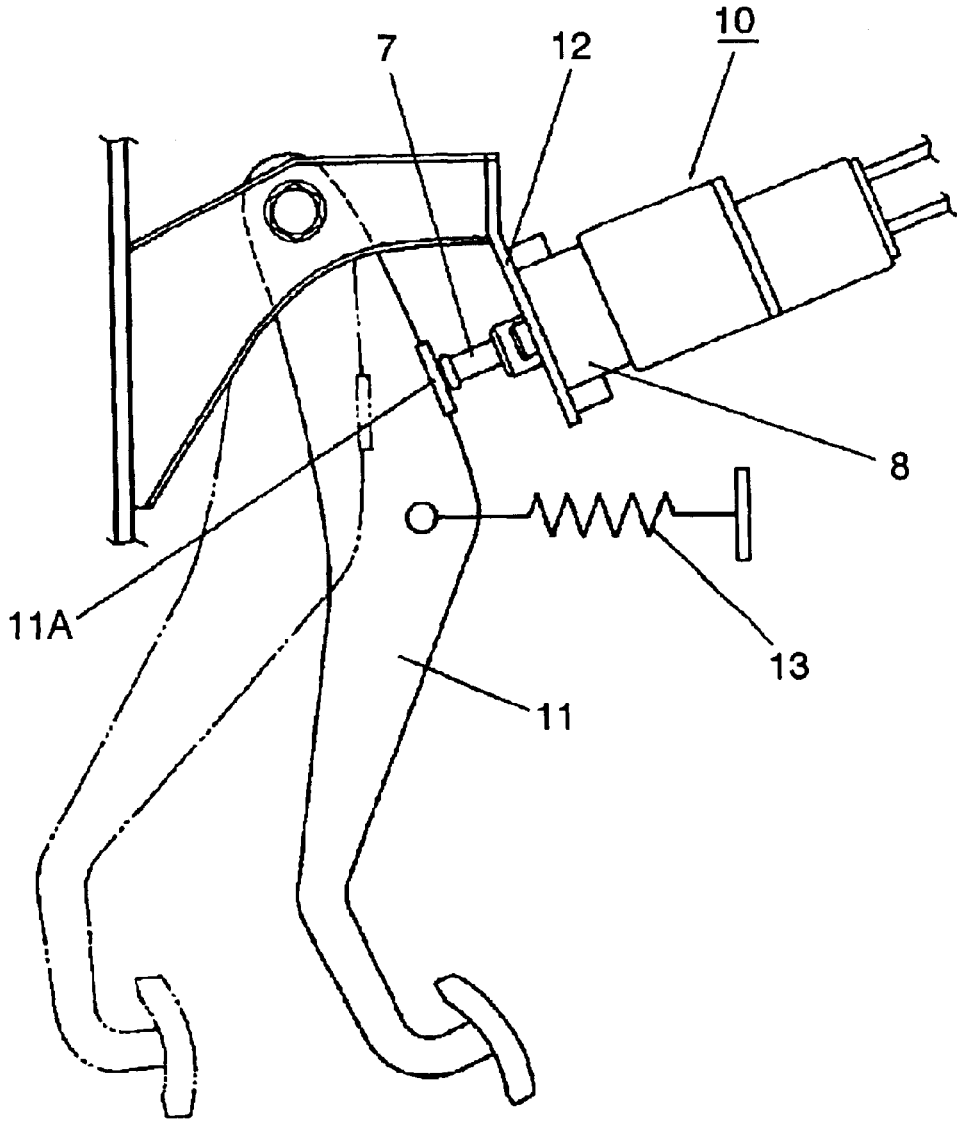
FIG. 10 PRIOR ART
FIG. 10 is an external view of a conventional method of mounting a stoplight switch on a vehicle.

Upon depressing brake pedal 11 in a state in which the length of action rod 27 has been adjusted, the switch contact is at "off" position, and stoplight is off as described above, as contact surface 11A is detached from action rod 27, action rod 27 is pressed by pressing spring 25 and return spring 26 as shown in the cross-sectional view of FIG. 8 and moved upward together with sliding body 22 that is secured by engagement spring 29. As the same time, movable contact 24 being pressed by pressing spring 25 comes into resilient contact with fixed contacts 23 thus bringing the switch contacts to an "on" state and causing the stoplight to light.

According to this exemplary embodiment, the stoplight switch is so structured that pressing section 30A on the side surface of spacer 30 that supports engagement spring 29 in an expanded state is projected out from through-hole 21B on the side surface of case 21 thereby to depress pressing section 30A so as to move spacer 30 and to secure action rod 27 and sliding body 22. Consequently, when mounting the stoplight switch on a vehicle, it is not necessary to hold the brake pedal. Thus a stoplight switch that is easy of mounting and adjusting the length of the action rod and a method of mounting it are provided.

Also, by providing slant section 30D on the bottom surface of contact portion 30C of spacer 30, as engagement spring 29 can be smoothly expanded and moved by slant section 30 when moving spacer 30 downward, readjustment of the length of action rod 27 after it has once been secured to sliding body 22 can be performed with ease.

Furthermore, by providing protruding section 27B at the bottom end of action rod 27 and making protruding section 27B engage the middle portion of engagement spring 29 supported by sliding body 22, action rod 27 can be temporarily held when inserting action rod 27 into hole 22A of sliding body 22 thus enabling easy assembly of a switch.

Moreover, as the position of spacer 30 can be confirmed by providing between pressing section 30A of spacer 30 and case 21 some perception means whereby the position of pressing section 30A can be known such as using different colors for spacer 30 and case 21 or putting a marking on the top surface of pressing section 30A, it will also become possible to visually confirm whether nor not action rod 27 is in a state of being secured to sliding body 22.

In the above description, with a view to enabling easy securing of action rod 27 to sliding body 22 or readjustment, reference was made to a configuration in which pressing section 30A that extends out on a side of spacer 30 is made to project out from through-hole 21B on a side of case 21. However, the present invention can also be embodied by a configuration in which the top surface of pressing section 30A is dented inwardly of a side of case 21 so that action rod 27 can be moved with a driver and the like along a groove provided on the top surface of pressing section 30A.

Also, for connection of terminal portions 23A of the switch to a stoplight, considering that other method such as directly soldering an electric wire to terminal portions 23A is possible in addition to the use of a connector or the like as described above, a configuration is adopted in which pressing section 30A is projected out from the side of case 21. However, the present invention may be similarly embodied by providing a pressing section at the bottom end of spacer 30 in a manner projecting out from bottom surface 21A of case 21.

Furthermore, though a single switch contact is formed with one movable contact 24 and a pair of fixed contacts 23, a plurality of switch contacts may be formed by means of a plurality of movable contacts and a plurality of fixed contacts.

Also, in the above description, though a switch contact for making electric "on" and "off" by means of up and down motion of sliding body 22 is described in which movable contact 24 mechanically comes into contact with and is detached from fixed contacts 23, the present invention can be embodied by configuring the switch contact by means of a magnetic system in which a magnet or the like is attached to action rod 27 and sliding body 22 and its magnetism is detected with a magnetic field sensing element such as a Hole element, or an optical system in which a light-emitting device or a photoreceptor device is used.

As has been described above, the present invention has an advantage of providing a stoplight switch which is easy to mount and to adjust the length of the action rod and a method of mounting the stoplight switch.

What is claimed is:

1. A stoplight switch comprising:

a cylindrical case made of insulating resin having an open upper surface;

a sliding body housed in said case in a manner vertically movable;

a switch contact for making electric connection and disconnection by vertical movement of said sliding body;

an action rod having a bottom end that is inserted into said sliding body;

a cover for covering the opening of said case having a through-hole through which said action rod projects upward;

a roughly U-shaped engagement spring supported by said sliding body; and a spacer for keeping said engagement spring in an expanded state in a manner such that the pressing section thereof extends out from the bottom surface or side surface of said case and a contact section thereof comes into contact with an end portion of said U-shaped engagement spring, wherein the end portion of said engagement spring is detached from said contact section and closed by the upward movement of said spacer so that said action rod can be secured relative to said sliding body.

2. The stoplight switch of claim 1 further comprising:

a slant portion on the bottom surface of said contact section of said spacer.

3. The stoplight switch of claim 1 further comprising:

a projecting section at the bottom end of said action rod wherein said projecting section engages said sliding body or said engagement spring.

4. The stoplight switch of claim 1 further comprising: perception means for indicating position of said pressing section in between the pressing section of said spacer and said case.

5. A method for mounting a stoplight switch, said stoplight switch comprising:

a cylindrical case made of insulating resin having an open upper surface;

a sliding body housed in said case in a manner vertically movable;

a switch contact for making electric connection and disconnection by vertical movement of said sliding body;

an action rod having a bottom end that is inserted into said sliding body;

a cover for covering the opening of said case and having a through-hole through which said action rod projects upward;

a roughly U-shaped engagement spring supported by said sliding body; and a spacer for keeping said engagement spring in an expanded state in a manner such that the pressing section thereof extends out from the bottom surface or side surface of said case and a contact section thereof comes into contact with an end portion of said U-shaped engagement spring, wherein the end portion of said engagement spring is detached from said contact section and closed by the upward movement of said spacer so that said action rod can be secured relative to said sliding body, wherein said stoplight switch is first mounted on a bracket for mounting a brake pedal and then said spacer is moved upward by upwardly pushing said pressing section thereby securing said sliding body and said action rod.

* * * * *